United States Patent [19]

Krambrock et al.

[11] Patent Number: 4,528,092

[45] Date of Patent: Jul. 9, 1985

[54] AIR CLASSIFIER

[75] Inventors: Wolfgang Krambrock; Hans Hoppe, both of Vogt, Fed. Rep. of Germany

[73] Assignee: Waeschle Maschinenfabrik GmbH, Ravensburg, Fed. Rep. of Germany

[21] Appl. No.: 463,047

[22] Filed: Feb. 1, 1983

[30] Foreign Application Priority Data

Feb. 1, 1982 [DE] Fed. Rep. of Germany ..... 3203209

[51] Int. Cl.[3] ..... B07B 11/06; B07B 4/02

[52] U.S. Cl. ..... 209/139 R; 209/138; 209/150

[58] Field of Search ..... 209/138, 139 R, 140, 209/141, 142, 143, 145, 150

[56] References Cited

U.S. PATENT DOCUMENTS

| | | | |
|---|---|---|---|
| 234,724 | 11/1880 | Prinz | 209/139.1 |
| 4,266,673 | 5/1981 | Haidlen et al. | 209/139.1 |
| 4,288,318 | 9/1981 | Essmann et al. | 209/139.1 |
| 4,299,693 | 11/1981 | Paulson | 209/138 |

FOREIGN PATENT DOCUMENTS

| | | | |
|---|---|---|---|
| 1012847 | 8/1964 | United Kingdom | 209/139.1 |
| 485767 | 12/1972 | U.S.S.R. | 209/144 |

*Primary Examiner*—Frank W. Lutter
*Assistant Examiner*—Wm. Bond
*Attorney, Agent, or Firm*—Murray Schaffer

[57] ABSTRACT

An air classifier having an upright housing open at both ends in which a pipe section is concentrically located to define a first annular passage closed at its upper end. A feed conduit attached to a pneumatic delivery system is concentrically located within the pipe section defining a second annular passage open at both ends. A cover is mounted over the upper end of the housing defining a dispersing chamber for bulk material. The dispersed material falls through the second passage, beyond the lower end of the pipe into an annular chamber where the components are separated by an air stream moving upwardly. The heavier particles falls and the lighter particle travel with the upward air.

3 Claims, 1 Drawing Figure

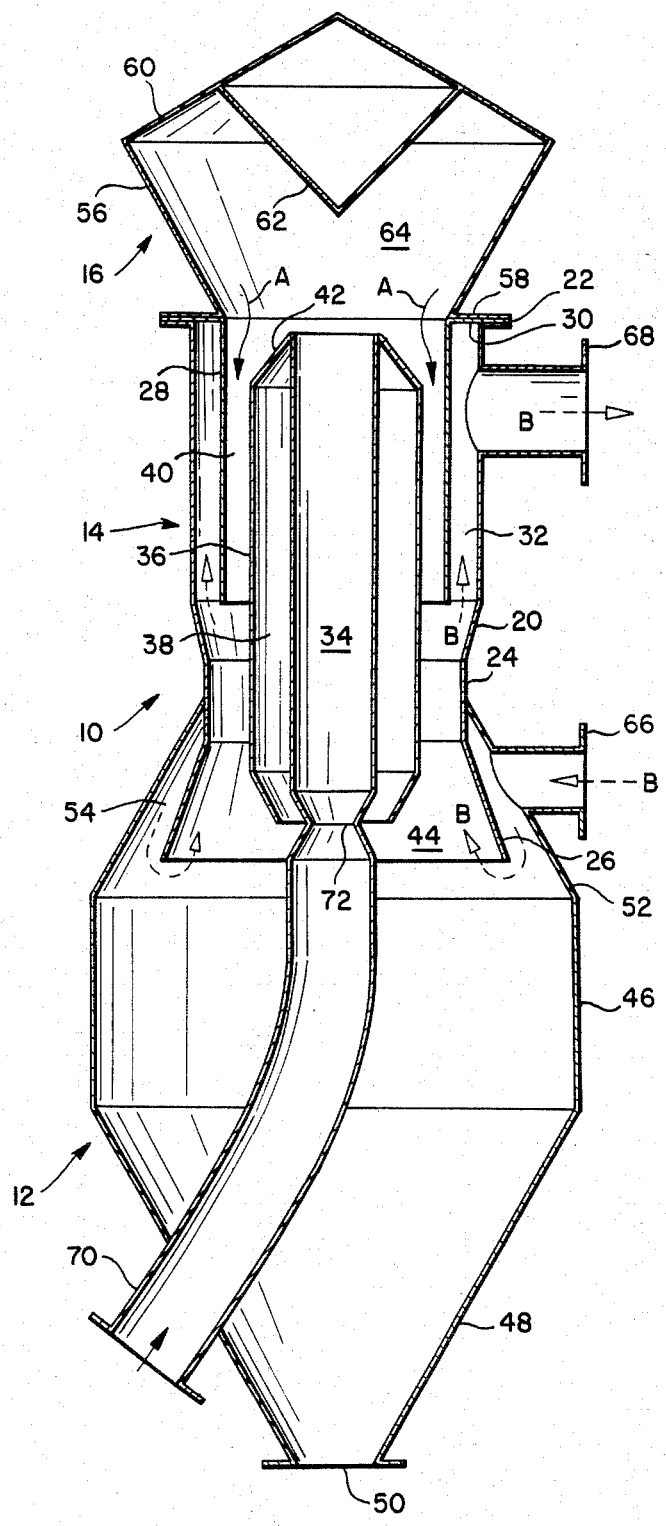
60
56
62
64
16
A
42
A
58
22
30
68
28
B
40
14
36
32
38
34
B
20
24
10
66
B
54
B
44
26
72
52
46
12
70
48
50

AIR CLASSIFIER

BACKGROUND OF THE INVENTION

The present invention relates to an air classifier and in particular to apparatus for separating dust particles from larger particulate or granulate materials.

Air classifiers are known comprising a pipe section concentricly arranged about a displacement body thereby defining an annular space. The pipe section is in turn enclosed by a second pipe section which defines with it a second annulus. The second pipe section projects below the lower end of the first pipe section into the upper part of a receiving container, which is provided near its upper end with an inlet for the classifying air. The bulk material which is to be separated is introduced into the top of the first or inner pipe section and falls downwardly through it, until it reaches the area of the surrounding outer or second pipe, where it is contacted by the incoming classifying air. The classifying air deflects the bulk material separating the dust from it and carrying the dust upward through the second or outer annulus to an outlet.

Such air classifiers are used for instance in the processing of plastic materials, in order to rid the granulates fed to the extruder of dust which for example adhere to the granulates by electrostatic charge. Such dust, carried along with the granulates might otherwise foul the extruder or cause difficulties in production such as forming irregularties in extruded foils or ruptures in the threads spun in the extruder.

In such deflection classifiers, the bulk material to be separated is blown pneumaticly into the classifier and flows through the first annular space by gravity. At the end of the annular space the bulk material first enters the deflecting air stream of classifying air. The volume of air in the stream may be adjusted so that the velocity equals approximately the speed of the falling granulates. The larger particles penetrate the classifying air due to their greater kinetic energy and are collected in the lower receiving container. The fine particles or dust are however braked in their fall, deflected upwards and are carried away by the air stream, through the outer annulus. The separated bulk material is removed from the container by way of a cellular wheel sluice or other discharge device. The dust and fine particles are removed from the air stream by a dust separator.

While the advantage of this principle of separation lies in the fact that the tear-off (detaching) forces between the granulate material and the dust lie in the range which is about 20-fold the detaching forces attainable in a gravity classifier and in addition the relatively high velocity of the bulk material leads to shorter dwell periods and smaller structural sizes in the separator portion, the hourly throughput of the bulk material on the other hand is limited to roughly 20 to 25 tons per hour. Such limits cannot be overcome merely by enlarging the dimensions of the deflection separator. Critical to the maximum throughput is the area of the annular gap between the displacement body and the first or inner pipe section. An enlargement of this gap width will cause the stream of granulate flowing out of the lower end of the first or inner pipe section to be expanded by the current of the classifying air flowing in the opposite direction to such an extent that a part of the granulate grain will impact the wall of the outer second pipe section and will be braked as a result, to an extent that it will be carried along by the air current with the dust portion. An enlargement of the diameters of the displacement body, and the first and second pipe sections, while by maintaining for the reasons cited above the maximum possible width of the annular gap between the displacement body and the first pipe section would also result in a larger cross-sectional area of the first annular chamber and is therefore not possible because an even distribution of the bulk material over the entire area of the annular gap can no longer be guaranteed. The uneven dispersion of the bulk material observed in the conveying air is presumably attributed to the configuration of the pneumatic conveyor or system and in particular to the last pipe end by way of which the bulk material is fed from the conveying conduit into the classifier, and which as is known, causes the formation of strands and groups of material due to the deflection of the stream. These strands of insufficiently dispersed bulk material penetrate the air current in the form of locally increased concentrations, without the dust portions being detached.

It is the object of the present invention to provide an deflection classifier of the type described such that along with the maintenance of the high quality of separation, the maximum quantity of bulk material capable of being conveyed per time unit can be substatially increased.

This object as well as others together with the numerous advantages of the present invention will be apparent from the following disclosure of the present invention.

SUMMARY OF THE PRESENT INVENTION

According to the present invention classification and separation are enhanced by pneumaticly feeding the bulk material upward through the central deflection body into an area above the annular chamber wherein the bulk material is dispersed before falling into contact with the classifying air. In this area above the annular chamber, the bulk material contacts a conically shaped roof or ceiling which further causes the bulk material to break-up and evenly disperse the bulk material across the cross-sectional opening gap of the annular chamber before it begins its downward fall.

Particularly, the present invention provides an air classifier comprising an upright housing open at both ends in which a pipe section is concentrically located to define therewith a first annular passage closed at its upper end. A feed conduit attached to a pneumatic delivery system concentrically located within the pipe section to define therewith a second annular passage open at both ends. A cover is mounted over the upper end of the housing defining a chamber for dispersing bulk material received from the feed conduit, the dispersed material then falling through the said second passage. The feed conduit projects beyond the lower end of the pipe section defining with the housng an annular chamber for separating the bulk material falling therein and communicating with said first and second passages. A container for receiving a separated portion from said chamber is mounted on said housing and extends below the annular separation chamber, classifying air is supplied to the chamber withdrawn from the first passage.

A conical member is mounted in the cover in opposition to the feed conduit increasing the dispersion of the bulk material. The feed conduit is provided with a narrowed neck portion which also increases loosening and dispersion of the bulk material.

Full details of the present invention are set forth in following description and are illustrated in the accompanying drawing.

BRIEF DESCRIPTION OF THE DRAWING

In the drawing, the FIGURE is a vertical cross sectional view of a classifier embodying the principles of the present invention.

DESCRIPTION OF THE INVENTION

As seen in the drawing, the classifier generally depicted by the numeral 10, comprises basicly three sections; a lower receiving section 12, for receipt of the separated granular material, a central separator section 14 in which separation of the dust and granular material is effected and a cover or deflection section 16.

The separator section comprises an outer generally cylindrical housing 20, terminating at its upper edge in radially outwardly directed flange 22 and at its lower end in a narrowed waist 24 and an outwardly flaring skirt 26. Set concentrically within the cylindrical housing 20 is a pipe section 28 of smaller diameter. The pipe section has a radially outward flange 30 which sits on the flange 22, where it may be welded, bolted or otherwise secured to close the top of the annular passage 32 thus defined between the housing 20 and the pipe section 28, the passage 32 being open at the bottom.

Set also concentrically within the pipe section 28 and extending downwardly beyond the narrowed waist 24 of the housing 20 is a feed conduit 34 provided with a deflection jacket 36 spaced therefrom, to define with the feed conduit 34 an annular space 38, and with the pipe section 28 still another annular passage 40. The upper end of the jacket 36 is closed by an annular end member 42 which tapers downwardly and outwardly while the lower end of the jacket is free. By providing the feed conduit 34 with a jacket 36, the conduit 34 can be made of optimum size for feeding bulk material while the gap or distance across the passage 40 can be also, optimumally made. Both the lower end of the feed conduit 34 and jacket 36 are tapered inwardly toward the central axis, and terminate just above the lower edge of the skirt 26 of the housing The upper end of the feed conduit 34 terminates just below the horizontal plane of the flange 22. The lower end of the pipe section 28 terminates at the point where the housing tapers to form the waist and well above the lower end of the feed conduit 34. The annular area beneath the pipe section 28 and above the lower edge of the housing skirt 26 forms a separation chamber 44.

The receiving section 12 comprises a cylindrical central portion 46, a lower funnel section 48, having an outlet port and an upper conical inwardly tapering section 52 which surrounds the skirt 26 of the housing to define therewith yet another annular space 54.

The cover section 16 comprises a diamond shaped closed cover formed by lower conical section 56 which is provided with a radially outward flange 58 which is seated and securable to the housing flange 22, and an upper pointed section 60 the apex of which lies concentric with the uptake pipe 34. The cover can be made integral with the pipe section 28 and only one flange provided.

A deflection cone 62 is mounted within the cover. The cone 62 is inverted and its apex lies in opposition to the axis of the feed conduit. The cover defines a chamber 64 open to both the feed conduit 34 and the surrounding annular passage 40.

An air intake connection port 66 is located in the upper section 52 of the lower container and communicates directly with the space 54 surrounding the housing skirt 26. An air outlet connection 68 is located below the flange 22 and communicates with the annular passage 32.

Bulk material is fed pneumatically, by conventional conveyor means, through a curved inlet conduct 70, which terminates in a vertical inner end secured end to end with the lower end of the feed conduit 34. The end of the vertical section is tapered and forms with the inwardly tapered end of the pipe 34 a cross-sectionally constricted neck 72.

The bulk material is introduced through the feed conduit 34 under pneumatic pressure, where it discharges into the deflection cover 16. The heavier material and the dust swirl within the cover and tend after loosening to fall, by gravitational force through the annular passage 40, following the path of arrows A. Simultaneous, air is forced into the separator section through the inlet 66. The incoming air there swirls about the annulus 52 and then upwardly through the chamber 44 and passage 32, following arrows B, to be withdrawn through the outlet 68. A suitable air circulatory system comprising a pump and/or vacumm source can be used. The system includes as is connection regulatory means for controlling velocity and volumne of air flow.

The light dust particles of the incoming bulk material exiting from the annular passage 40 are deflected from the downward path within the separator chamber 44 from the heavier granulates, and are carried off with the air flow stream B, through the outlet 68. The air circulatory system includes a filter or other dust separation device for capturing the dust. The granulates fall into the container section 12, where they can be stored for eventual mass discharge through opening 50 or continuously let out through the opening, by suitable wheel or sluice.

In operation, the bulk material, containing dust and granulate is fed from below and is blown first against the deflection cone 62, in the cover 16. This effects a uniform dispersion of the material, prior to the gravitational forces act upon it which cause the material to fall into the annular passage 40. It is therefore possible, by maintaining the width of the gap (i.e. radial space) of the annular chamber, to increase substantially the circumference of the latter by simply enlargeing the diameters of the respective parts of the classifier, without any resultant uneven distribution of the bulk material in the annular passage 40 and without any deterimental effect on classification and the quality of such classification. It has been ascertained that at any rate a throughput of bulk material in quantities of up to 50 tons per hour is attainable in this manner without a reduction of the separating quality.

An additional advantage lies in the fact that feeding of the bulk material from below simplifies the guidance and mounting of the supply conduit and in particular makes it unnecessary to arrange the feed conduit above in intake pipe in an exposed position on the roof of high silos, where special anchoring means are required.

While, in the present classifier, the bulk material to be separated must be fed to the intake by a suitable conduit itself having a bend, the bend can have a large radius of curvature. Secondly, feeding the bulk material upwardly into vertically disposed uptake pipe make possible the use of low conveying velocities for the bulk material. The deflection cone also enables the disolution of potentially existing, local concentrations of material, and although shown as concentric with the central vertical axis of the classifier, the apex of the deflector cone may be arranged off-center to provide additional evening or distribution of the bulk material.

The formation of a cover member having outwardly conical walls provides an area permitting the even dispersion of the incoming bulk material and a more even distribution over the entire cross section of the downward annular chamber. A similar advantageous dispersion of the incoming bulk material is obtained by the reduced cross sectional neck formed between the intake conduit and the vertical feed conduit, which while restricting the flow of bulk material causes a more rapid explosive movement once past the neck.

Various modifications and changes have been shown and suggested herein. Other will be obvious to those skilled in this art. Accordingly, this disclosure is to be taken as illustrative and not limiting of the present invention.

What is claimed is:

1. An air classifier comprising an upright housing open at both ends, a cylindrical pipe section having means concentrically locating said pipe section within the upper end of said housing and defining therewith a first annular passage closed at its upper end, a cylindrical feed conduit for attachment to pneumatic delivery system for bulk material to be separated extending upwardly and concentrically within said pipe section and defining therewith a second annular passage of constant width open at both ends, a cover mounted on the upper end of said housing defining above said feed conduit and said second annular passage a chamber for dispersing bulk material emerging from the upper end of said feed conduit, said cover comprising a dome shaped enclosure, having an upwardly and outwardly flaring lower section secured to said housing radially exterior of said second annular passage, an upwardly and inwardly flaring upper section and a conical deflecting member mounted on the interior surface of the upwardly an inwardly flaring upper section of the enclosure concentric with said pipe sections in opposition to the upper end of said feed conduit and said feed conduit having a narrowed end section at the point of connection with said pneumatic delivery means to restrict entry into said feed conduit, said feed conduit projecting beyond the lower end of said pipe section and defining with said housing a separating chamber for separating the component parts of said bulk material communicating with said first and second passages, a container for receiving a separated portion from said separating chamber, mounted on said housing and extending below said annular separation chamber, inlet means for supplying classifying air to said separating chamber, and outlet means for withdrawing said classifying air from said first annular passage.

2. The classifier according to claim 1 wherein said container is at least in part spaced exterior of said housing to provide an annular space therebetween and said inlet means for supplying classifying air is located in said container in communication with said annular space.

3. The classifier according to claim 1 wherein said feed conduit includes a surrounding jacket spaced therefrom to provide a deflection body for bulk material passing through said second passage.

* * * * *